United States Patent [19]

Kavesh et al.

[11] 4,356,138

[45] Oct. 26, 1982

[54] PRODUCTION OF HIGH STRENGTH POLYETHYLENE FILAMENTS

[75] Inventors: Sheldon Kavesh, Whippany; Dusan C. Prevorsek, Morristown; Donald G. Wang, Morris Plains, all of N.J.

[73] Assignee: Allied Corporation, Morris Township, Morris County, N.J.

[21] Appl. No.: 225,288

[22] Filed: Jan. 15, 1981

[51] Int. Cl.[3] ..... B29C 17/02

[52] U.S. Cl. ..... 264/164; 264/184; 264/210.8; 528/502

[58] Field of Search ..... 264/164, 184, 215; 528/502; 526/352

[56] References Cited

U.S. PATENT DOCUMENTS

| | | | |
|---|---|---|---|
| 2,923,979 | 2/1960 | Kalil | 264/215 |
| 3,032,816 | 5/1962 | Zimmerli | 264/215 |
| 3,990,829 | 11/1976 | Frank et al. | 264/176 F |
| 4,020,266 | 4/1977 | Frank et al. | 528/502 |
| 4,137,394 | 1/1979 | Meihnuizen et al. | 528/502 |

OTHER PUBLICATIONS

A. J. Pennings et al., Colloid & Polymer Sci., vol. 257, pp. 547–549 (1979) "Longitudinal Growth Of Polymer Crystal From Flowing Solutions VII".

*Primary Examiner*—Jay H. Woo

*Attorney, Agent, or Firm*—Alan M. Doernberg; Gerhard H. Fuchs; Robert A. Harman

[57] ABSTRACT

Production of polyethylene filaments of tenacity at least 30 g/d from a hot, supersaturated solution of high viscosity polyethylene having intrinsic viscosity of at least 11 dl/g, by contacting a length of such filament (functioning as a seed) simultaneously with a stationary arcuate surface and with such polyethylene solution, and withdrawing the filament through the solution in sliding contact around the surface at a rate reaching at least 80 cm per minute thereby producing tension and inducing crystal growth from the solution onto the filament, with increase of tension up to a steady state tension of at least 70 grams. More particularly the polyethylene has intrinsic viscosity of 17–28 dl/g, the solvent is xylene, the surface is composed of PTFE, the polyethylene concentration is 0.1 to 0.5 wgt. percent, the rate of withdrawing the filament is at least 200 cm per minute, and the polyethylene seed filament is initially led around the arcuate surface by attaching the filament to an endless loop which is drawn through the solution and around the surface; and then the seed filament is passed to a takeup reel; and afterward (when the tension has reached at least 70 g) the seed filament is severed from its supply source while growth of the product filament on the seed filament and from the end thereof proceeds.

7 Claims, 5 Drawing Figures

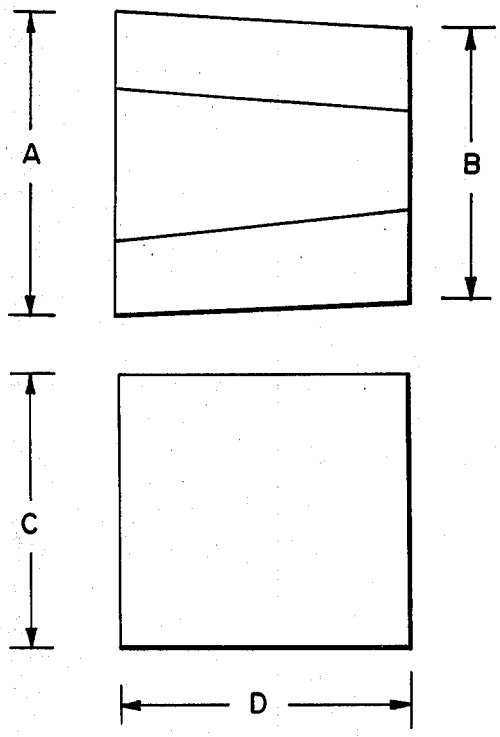
FIG. 2
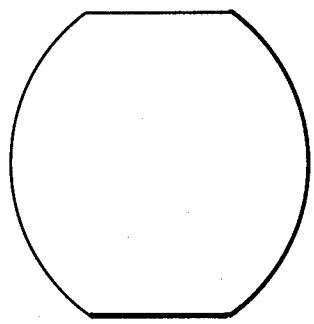
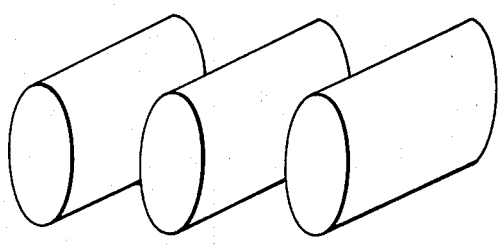
FIG. 4
FIG. 5
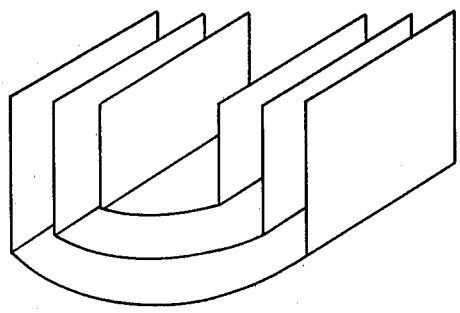

PRODUCTION OF HIGH STRENGTH POLYETHYLENE FILAMENTS

BACKGROUND OF THE INVENTION

This invention relates to process for production of high strength polyethylene filaments having tenacity of at least 30 grams per denier (g/d).

It is known (U.S. Pat. No. 4,137,394 of Jan. 30, 1979 to Meihuizen et al.) to produce polyethylene filaments having tenacity of at least about 30 grams per denier from a hot, supersaturated polyethylene solution, said polyethylene having intrinsic viscosity in decalin at 135° C. of at least 15 dl/g. The concentration was in the range of 0.05–5 weight percent, particulrly 0.5 weight percent in the examples. The solution was maintained at a temperature of about 110° C., according to the examples, and was in xylene as the solvent. A stabilizer (specifically Ionol DBPC, i.e., di-tertiary-butyl-paracresol) was employed. The tests were conducted under pure nitrogen.

A run was started using fibrous polyethylene crystal filaments about 4 cm long, introduced so as to contact a cylindrical rotor turning in the polyethylene solution. As the rotor turned, the end of the fibrous crystal material was carried with the rotor through the solution, and crystals of polyethylene formed at such end so that the filament grew in length, until at least about 15 cm of filament was wrapped around the rotor. The temperature was adjusted to a point of equilibrium such that crystallization would occur while polyethylene remained in solution. The growing filament was then withdrawn from the solution at a rate about equal to the rate of growth and in the direction opposite to the direction of rotation of the rotor. The rate of growth in cm per minute is indicated in FIG. 2 to vary from 18.8 to 78.0, on the basis that this rate of growth is equal to the rate of takeup, i.e., the reeling speed. This reeling speed is not more than half the peripheral speed of the rotor (U.S. Pat. No. 4,137,394, col. 3, lines 57–66).

In a literature article (Colloid and Polymer Science volume 257 of 1979 at pages 547–549 a like process is disclosed wherein specifically the rotor is horizontally mounted rather than being vertical and is only partially immersed in the polyethylene solution.

This prior art process of U.S. Pat. No. 4,137,394 produces high strength filaments, but not necessarily of uniform denier nor in long lengths and the denier, i,e, weight in grams per 9,000 meters, is only about 1. See col. 5, line 1. This literature article at page 547, column 1, first paragraph, indicates a maximum growth rate of 26 mm/sec., i,e, 156 cm/minute.

What is needed in the art is a more rapid process, capable of forming single and multiple filaments of higher denier and of running smoothly without interruption, which can be readily started up and which can be carried out without requiring visual observation for adjustment, thus allowing use of vessels constructed of metal rather than requiring a transparent construction material such as glass.

SUMMARY OF THE INVENTION

In the present invention, a filament of appropriately high molecular weight polyethylene, like that which is in the solution from which the subject filaments are to be spun, is used to provide polyethylene seed along its length, instead of using a relatively short fibrous polyethylene crystal as employed in the prior art. A length of the seed filament is contacted simultaneously with a stationary arcuate surface, which need not be a surface of revolution, and with a hot, supersaturated polyethylene solution. Instead of rotating the arcuate surface to induce crystal growth at the terminus of a seed crystal, the length of seed filament is led first around the stationary arcuate surface over an arc which, when the filament is pulled, produces a tension in said filament. The seed filament is then withdrawn at a rate of at least 80 cm per minute whereby, we have found, the growth of fibrous polyethylene crystals from the solution onto the surface of the seed filament is induced. As the denier of the filament increases, the rate of withdrawing the filament can be increased since the filament is now stronger than before. An increase in tension will accordingly be noted. Preferably the rate of withdrawal will be brought to at least 200 cm per minute and the tension will be at least 70 grams.

DRAWINGS

FIG. 1 diagrammatically illustrates the form of the apparatus used in the Examples 1 and 2 below.

FIG. 2 shows in greater detail the construction of the arcuate surface used in those Examples.

FIGS. 4 and 5 illustrate certain arrays of arcuate surfaces to be used in simultaneous production of a plurality of filaments or strands in accordance with this invention.

DETAILED DESCRIPTION

Referring now to preferred details observed in our process, the polyethylene used desirably will have intrinsic viscosity in denier at 135° C. of at least 11 dl/g, and preferably intrinsic viscosity in the range of 17–28 dl/g. The growth process is sensitive to the concentration of the solution and the temperature, as will be appreciated from the fact that the growth due to crystallization of polyethylene on the seed filament must be balanced against the necessity of maintaining an adequate concentration of polyethylene in solution. Desirable concentrations are in the range between about 0.1 and about 0.5 weight percent, using solvents such as xylene, chlorobenzene or decalin. If a filament is being produced from such a solution without replenishment of the solution, the concentration of polyethylene in the solution will necessarily decrease due to depletion of the solution in polyethylene. We have found that such a drop in concentration results in thinning out of the filament; but that such depletion can be compensated by continuous addition of fresh polymer solution and continuous withdrawal of the partially spent polymer solution. By such measures a filament of essentially constant denier can be prepared.

A typical filament as obtained by our process, without after treatment, can have denier such as 10–20 with tenacity about 30–35 g/d, UE about 5% and tensile modulus about 1,000 g/d; all as measured by conventional methods. These properties can be altered by conventional treatments with heat and/or stretching.

Figure 1:
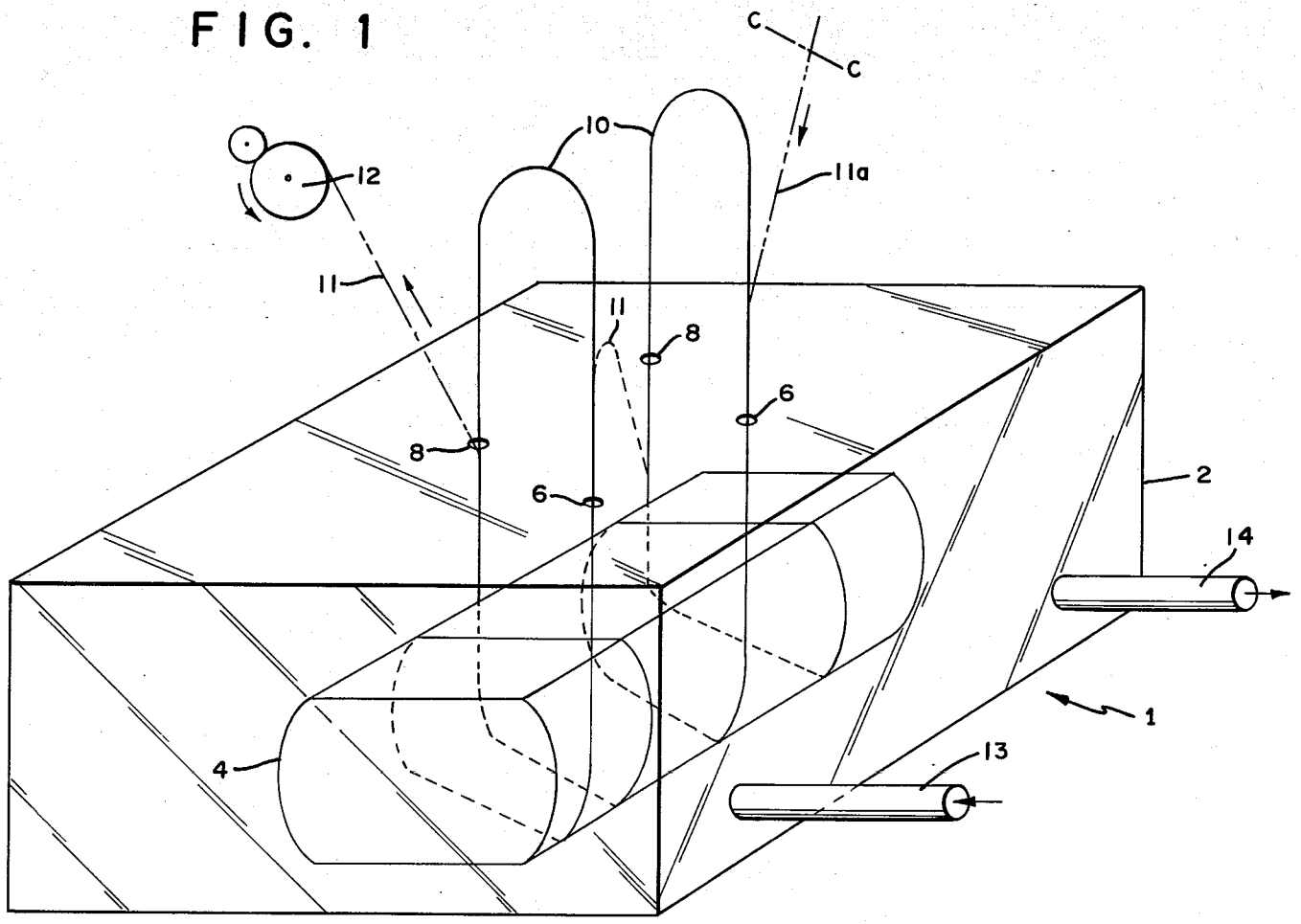

In FIG. 1 of drawing, the overall apparatus or growth cell (1) is shown as comprising a closed container (2) for the polyethylene solution used to produce the subject fiber; an arcuate surface (4) which is preferably composed of PTFE; inlet fiber ports (6) and outlet ports (8); and two continuous loops (10) of nylon or other strong, flexible, high melting material. For the sake of clarity of illustration, container (2) is shown as being made of glass; but any desired construction material, for example, steel or aluminum, can be used. The growth cell is fitted with a solution feed tube (13) and a solution withdrawal tube (14), and with a takeup device (12) for collecting the two filaments produced.

An inert gas atmosphere such as nitrogen is maintained in the vapor phase of the container (2) by connection to an appropriate source (not shown). The cell is maintained at controlled temperatures, suitably by immersion in a heated oil bath (not shown).

Figure 3:
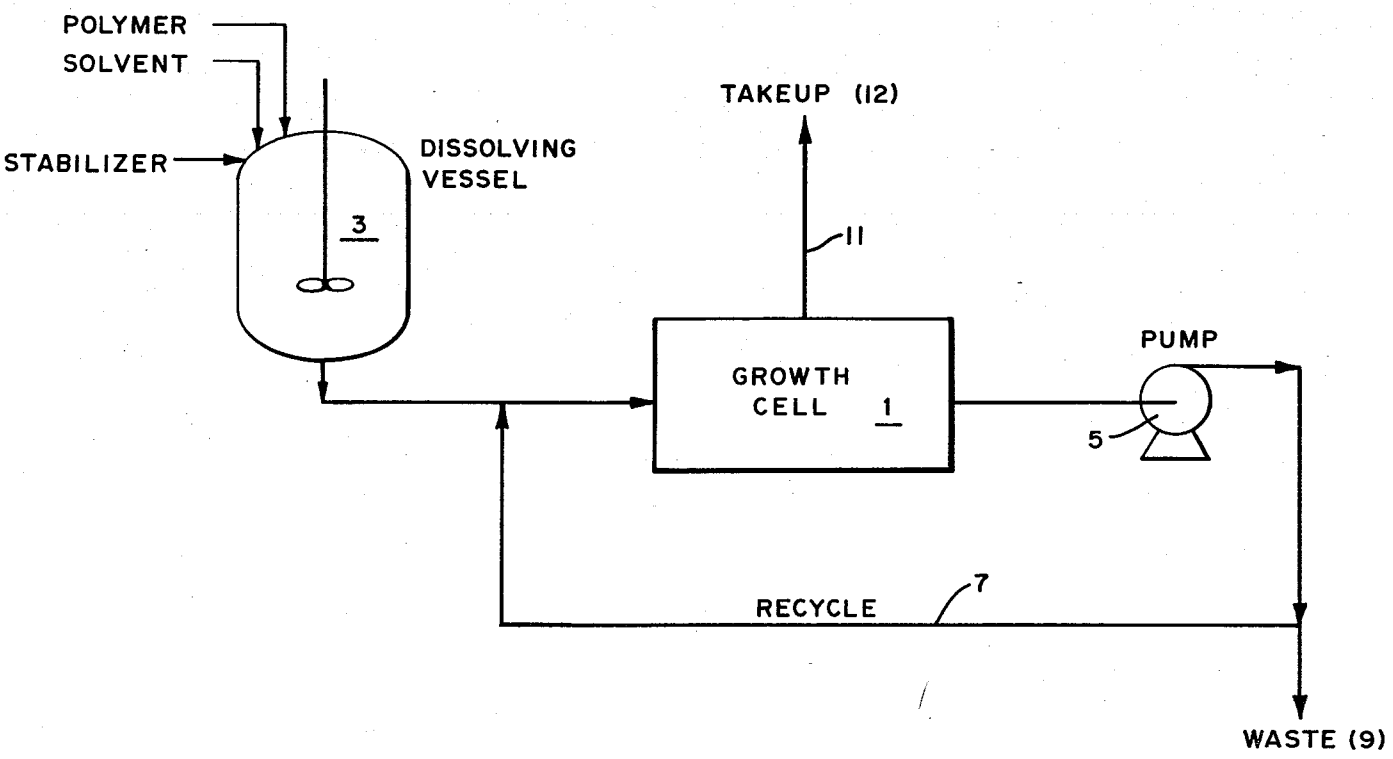
FIG. 3 is a flow chart schematically illustrating a continuous process in accordance with this invention.

In the flow chart of FIG. 3, illustrating continuous operation, reference numeral (1) designates the growth cell illustrated by FIG. 1; (3) is an agitated dissolving vessel from which fresh polymer solution can be fed to the growth cell; (5) is a pump for continuously withdrawing solution from cell (1), recycling through line (7) and withdrawing a portion to waste at (9). The filaments (11) produced are collected at takeup position (12).

In operation two continuous loops (10) surround the arcuate surface (4). "Seed" filaments of polyethylene (11), (11*a*) are attached to the loops (10). The loops (10) are pulled through the growth cell, drawing the seed filaments (11) into the growth cell and around the arcuate surface (4), following the path of the loops as indicated by the arrows. Each seed filament, when it has emerged through its outlet port (8) is detached from its loop (10) and carried to takeup device (12). As the takeup device is driven, the seed filaments slide around the arcuate surface (4). The resulting tension on each seed filament is measured.

An increase in tension for a given speed of taking up a seed filament indicates that growth of polyethylene crystals upon the seed filament has commenced. This growth process is allowed to continue until the seed filament is seen to emerge in thickened form from its outlet port (8) and the tension has reached at least 70 grams, and the rate of withdrawal of the growing filament has reached at least 80 cm/min.

The seed filament is now cut between its supply source and its inlet port (6), as indicated in FIG. 1 by the loose end illustrated for filament (11) and the line C—C across filament (11*a*).

As takeup continues, the tension is observed to rise until an approximately steady state level is reached, which depends upon the curvature of the surface, the path of the filament around the surface, the concentration of the polyethylene solution, the rate of withdrawing the filament and the temperature at which the oil bath and consequently the polyethylene solution is maintained. The tension values are generally in the range from 0 to about 1,000 grams. The effect of applying tension to the filament, we have found, is that the crystallization of polyethylene from solution proceeds upon the seed filament, to increase its denier; and after the severance of the seed filament, growth proceeds also at the free end of this filament. Faster takeup creates higher tension and this results in a higher growth rate, up to a point of equilibrium. At takeup speed higher than such equilibrium rate, the filament thins out and breaks or the end is pulled around and off the surface.

In contrast to prior art, scale-up of our process to greater numbers of filaments or strands can be readily accomplished without proportionately increasing the size of the apparatus or the complexity of its operation. The use of various stationary arcuate surfaces, which are not surfaces of revolution, enables high efficiency of space utilization within the growth cell. FIG. 4 illustrates an array of juxtaposed structures having the form in cross section of ellipses with relatively short minor axes. FIG. 5 illustrates a structure comprising a multiplicity of members each with an arcuate bottom surface and open at the top, whereby they can be positioned stackwise, each above and within the one below. These arcuate surfaces may have different radii of curvature, if desired, whereby for example the friction of the filaments sliding across these surfaces can be adjusted to compensate for their differences in length.

The Examples which follow are illustrative of our process and of the best mode presently contemplated by us for carrying it out, but are not to be interpreted as limiting.

EXAMPLE 1

The growth cell illustrated diagramatically in FIG. 1 was charged with a solution consisting of 0.25 wt.% polyethylene, 0.5 wt.% antioxidant (2.6-Di-tert.-butyl-4-methylphenol) and 99.25 wt% commercial xylene. The intrinsic viscosity of the polyethylene, measured in decalin at 135° C. was 24 dl/g. The commercial xylene consists of 64.5 wt% m-xylene, 17.7 wt% o-xylene, 17.2 wt% ethylbenzene, and 0.6 wt% toluene. The arcuate surface within the growth cell was comprised of a tapered PTFE plug of non-circular crosssection shown in orthogonal views in FIG. 2. The dimensions A, B, C and D were respectively 4.4", 4.22", 3.79" and 4.4" (111.8, 107.2 g, 96.3 and 111.8 mm). The arcuate surface was submerged in the polymer solution. The temperature of the growth cell and its contents was regulated at 14.5° C.±0.2° C. by means of a surrounding constant temperature oil bath.

Two endless strands or loops (10) of 0.014 inch (0.356 mm) diam. nylon monofilament were disposed through the growth cell at each of the two inlet ports (6), looped 1½ turns about the arcuate surface and each emerged from the growth cell at an exit port (8). A supply reel of polyethylene seed filament was attached to one of those loops at an inlet port. The nylon loop was pulled through the cell until the polyethylene seed filament has passed fully through the cell and had emerged at an exit port. The emerging end of the seed filament was detached from the nylon loop and connected across a tensiometer to a takeup reel. The rotation of the takeup reel caused the portion of the seed filament within the growth cell to slide along the stationary arcuate surface in simultaneous contact with this surface and with the polymer solution. The speed of the takeup reel ws 200 cm/min. Initial tension in the seed filament was 20 g. Within a minute or two after connection to the take up reel, filament tension had increased to 70 g.

The seed filament was then severed between the supply reel and the inlet port. Nevertheless, filament tension continued to rise to 190 g in 15 min. and then declined slowly to 90 g. as the filament was collected for sixteen hours. The final polymer solution concentration was 0.11 wt% polymer.

The filament collected was vacuum dried at 60° C. for sixteen hours. It possessed the following properties.

| | At Start of Run | At End of Run |
|---|---|---|
| Denier | 17.7 | 6.7 |

-continued

| | At Start of Run | At End of Run |
|---|---|---|
| Tenacity, g/d | 33.1 | 33.6 |
| Elongation at break, % | 5 | 5 |
| Tensile Modulus, g/d | 998 | 953 |

EXAMPLE 2

The growth cell was charged at 114.5° C. with a 0.25 wt% solution of the same composition as described in Example 1. A polyethylene seed filament was attached to each of the two nylon monofilament loops at the inlet ports. The polyethylene seed filaments were drawn around the stationary arcuate surface and out of the growth cell by advancing the nylon loops.

The seed filaments were then detached from the nylon loops and connected across individual tensiometers to a single takeup device. The speed of the takeup device was set at 200 cm/min. As the tension in each filament increased to 70 g, that seed filament was severed between the supply reel and the inlet port. Filament tensions at this takeup reel continued to rise for about 15 minutes to about 260 g and 200 g respectively and then declined slowly as a two-filament fiber strand was collected for seven hours. The strand was vacuum dried at 60° C. for sixteen hours. The individual filaments possessed the following average properties: 14.9 and 12.0 denier, 33.0 and 33.9 g/d tenacity, 5.0 and 5.5% elongation, 981 and 939 g/d tensile modulus.

EXAMPLE 3

A 0.25 wt% polyethylene solution of the same composition as described in Example 1 is prepared in the polymer dissolving vessel (3) indicated schematically in FIG. 3. Part of this solution is transferred at 110° C. to the growth cell (4) to fill the growth cell above the level of the arcuate surface. Additionally, a continuous feed of the polymer solution is established between the polymer dissolving vessel and the fiber growth cell at the rate of 1.8 liters/h.

The polymer solution is circulated through the growth cell by pump (5) as illustrated schematically in FIG. 3. The flow of recirculating solution is at the rate of one volume of the growth cell every four hours. The level of the solution within the growth cell is regulated by continuously bleeding 1.8 liters/h of solution from the recirculating stream into a waste container (9).

Filament growth is commenced by carrying a polyethylene seed filament to the takeup position under light contact with the stationary arcuate surface immersed in this polymer solution, as described in Example 1, and taking up initially at a takeup speed of 200 cm/min. The tension on the seed filament rises over about a 15 minute period to 225 g.

The tension remains in the range of 200–250 g for an indefinitely long period as this filament is withdrawn continuously and the concentration of the polymer solution in the growth cell remains approximately constant. The filament collected is vacuum dried at 60° C. for sixteen hours.

No significant change in denier will be observed from the beginning to the end of these operations on the basis of a run of 61.5 h in which the solution was not replenished but the initial temperature of 117° C. was lowered after about 1 day to 112° C. and again after about 1 more day to 108° C. whereby the effect of depletion of the polymer tending to reduce the filament denier was contoured by approximately restoring the initial level of supersaturation by cooling. The filament resulting from this progressive cooling procedure averaged 17.5 denier, 31.5 g/d tenacity, 5% elongation, 948 g/d tensile modulus.

We claim:

1. In a process for production of polyethylene filaments having a tenacity of at least 30 grams per denier from a hot, supersaturated polyethylene solution, said polyethylene having intrinsic viscosity in decalin at 135° C. of at least 11 dl per gram and said solution being at a temperature in the range of about 102°–120° C. and concentration in the range of 0.1–2 weight percent, said process comprising contacting fibrous seed crystals of such polyethylene with a generally arcuate surface which is at least partially immersed in said polyethylene solution whereby crystal growth is initiated by said seed crystals, and withdrawing a resulting filament:

The improvement which comprises utilizing to provide polyethylene seed, a length of filament of polyethylene as aforesaid, in contact simultaneously with said arcuate surface and said solution; maintaining said arcuate surface essentially stationary; and withdrawing the filament from said solution around said stationary arcuate surface at a rate reaching at least 80 cm per minute thereby producing tension in said filament and inducing growth of fibrous polyethylene crystals from the solution onto said filament with resulting increase in tension on the filament being withdrawn, up to a steady state tension of at least 70 grams.

2. Process of claim 1 wherein the tension is maintained approximately at the steady state level by replenishing the polymer solution so as to maintain its concentration approximately constant.

3. Process of claim 2 wherein the replenishment is continuous and is balanced by continuous withdrawal of solution from the system.

4. Process of claim 1 wherein the arcuate surface is composed of polytetrafluoroethylene; the solvent is xylene; the concentration of polyethylene is in the range of 0.1 to 0.5 weight percent; the rate of withdrawing the growing filament is at least 200 cm per minute; and the tension is in the range between about 70 g and about 1000 g.

5. Process of claim 4 wherein the polyethylene has intrinsic viscosity in the range of 17–28 dl/g.

6. Process of claim 1 wherein a seed filament of polyethylene as aforesaid coming from a source position is attached to a point on a closed loop of flexible material which is drawn in a helical path around said arcuate surface and through said polyethylene solution, thereby leading said seed filament in a similar path; passing said seed filament to a takeup device and withdrawing the filament at a rate of at least 80 cm/min. and when the tension on said filament has increased and reached at least 70 g, severing said seed filament between its source and its point of inlet into the polyethylene solution.

7. The process of claim 1 wherein said filament has a denier between 10 and 20.

* * * * *